US005929368A

United States Patent [19]

Ewick et al.

[11] Patent Number: 5,929,368

[45] Date of Patent: Jul. 27, 1999

[54] HYBRID ELECTRONIC DETONATOR DELAY CIRCUIT ASSEMBLY

[75] Inventors: David W. Ewick, North Granby; Paul N. Marshall, Avon; Kenneth A. Rode, Granby; Thomas C. Tseka, West Suffield; Brendan M. Walsh, Simsbury, all of Conn.

[73] Assignee: The Ensign-Bickford Company, Simsbury, Conn.

[21] Appl. No.: 08/762,262

[22] Filed: Dec. 9, 1996

[51] Int. Cl.[6] ..... H03K 17/687; H03K 17/567; F42D 1/055

[52] U.S. Cl. ..... 102/215; 102/210; 102/218; 327/394; 327/398; 327/439; 327/433

[58] Field of Search ..... 102/206, 210, 102/215, 217, 218, 219, 220; 361/249, 251, 260; 327/433, 394, 398, 399, 439

[56] References Cited

U.S. PATENT DOCUMENTS

| | | | |
|---|---|---|---|
| 3,510,686 | 5/1970 | Zug | 102/220 |
| 3,981,240 | 9/1976 | Gladden . | |
| 4,001,610 | 1/1977 | Griffin | 307/293 |
| 4,056,414 | 11/1977 | Kopp | 148/175 |
| 4,141,298 | 2/1979 | Weidner | 102/210 |
| 4,240,350 | 12/1980 | Munzel et al. . | |
| 4,274,909 | 6/1981 | Venkataraman et al. | 156/648 |
| 4,282,538 | 8/1981 | Beelitz et al. | 357/15 |
| 4,434,717 | 3/1984 | Erickson . | |
| 4,571,818 | 2/1986 | Robinson et al. | 29/576 W |
| 4,586,437 | 5/1986 | Miki et al. . | |
| 4,607,573 | 8/1986 | Thureson et al. . | |
| 4,632,032 | 12/1986 | Muller . | |
| 4,648,320 | 3/1987 | Furst et al. . | |
| 4,674,047 | 6/1987 | Tyler et al. . | |
| 4,708,060 | 11/1987 | Bickes, Jr. et al. . | |
| 4,712,477 | 12/1987 | Aikou et al. . | |
| 4,730,558 | 3/1988 | Florin et al. . | |
| 4,777,880 | 10/1988 | Beattie et al. . | |
| 4,825,765 | 5/1989 | Ochi et al. . | |
| 4,829,899 | 5/1989 | Wiker et al. . | |
| 4,843,964 | 7/1989 | Bickes, Jr. et al. . | |
| 4,851,721 | 7/1989 | Okitaka | 307/570 |
| 4,869,170 | 9/1989 | Dahmberg et al. . | |
| 4,893,564 | 1/1990 | Ochi et al. . | |

(List continued on next page.)

FOREIGN PATENT DOCUMENTS 0555651 4/1997 European Pat. Off. .

OTHER PUBLICATIONS

J. Childs et al; Digidet™ Delay Detonators: . . . Blasting Blasting Technology, Instrumentation and . . . Applications Seminar, Jul. 1995.

D.W. Fyfe et al; BNCP Prototype Detonator Studies using a Semiconductor Bridge Initiator: Abstract, undated.

*Primary Examiner*—Charles T. Jordan
*Assistant Examiner*—Christopher K. Montgomery
*Attorney, Agent, or Firm*—Law Office of Victor E. Libert; Frederick A. Spaeth

[57] ABSTRACT

An electronic delay circuit (10) for use in a detonator (100) has a switching circuit (20) and a timer circuit (22). Switching circuit (20) controls the flow of a stored charge of electrical energy from a storage capacitor (12) to a bridge initiation element such as a semiconductor bridge (18) or a tungsten bridge. The timing of the release of this energy is controlled by timer circuit (22). Switching circuit (20) is an integrated, dielectrically isolated, bipolar CMOS (DI BiCMOS) circuit, whereas timer circuit (22) is a conventional CMOS circuit. The use of a DI BiCMOS switching circuit allows for greater efficiency of energy transfer from the storage capacitor (12) to the semiconductor bridge (18) than has previously been attained.

25 Claims, 3 Drawing Sheets

U.S. PATENT DOCUMENTS 4,923,826 5/1990 Jastrzebski et al. ..... 437/57
4,976,200 12/1990 Benson et al. .
4,986,183 1/1991 Jacob et al. .
5,029,529 7/1991 Mandigo et al. .
5,072,287 12/1991 Nakagawa et al. ..... 357/50
5,079,447 1/1992 Lien et al. ..... 307/446
5,089,429 2/1992 Hsu ..... 437/31
5,092,243 3/1992 Hawkins et al. .
5,133,257 7/1992 Jonsson .
5,173,569 12/1992 Pallanck et al. .
5,191,240 3/1993 Fleischer ..... 307/446
5,306,964 4/1994 Taylor ..... 307/446
5,309,841 5/1994 Hartman et al. .
5,363,765 11/1994 Aikou et al. .
5,377,592 1/1995 Rode et al. .
5,435,248 7/1995 Rode et al. .
5,460,093 10/1995 Prinz et al. .
5,495,806 3/1996 Willey .
5,507,230 4/1996 Lewis et al. .
5,661,046 8/1997 Ilderem et al. ..... 438/202

HYBRID ELECTRONIC DETONATOR DELAY CIRCUIT ASSEMBLY

BACKGROUND OF THE INVENTION

1. Field of the Invention

This invention relates to electronic detonator delay circuits.

2. Related Art

Electronic circuits for firing electrical initiation elements within detonators after a predetermined, electronically-controlled delay period are known. The delay period is measured from the receipt of a non-electric initiation signal which may also provide power for the timer circuit and for the initiation element. Thus, U.S. Pat. No. 5,133,257 to Jonsson, issued Jul. 28, 1992, discloses an ignition system comprising a piezoelectric transducer that can be disposed next to a detonating cord branch line. When the detonating cord detonates, it releases energy in the form of a shock wave, which induces the transducer to produce an electrical pulse. The electrical energy from the transducer is stored in a capacitor which provides power for a timer. After a predetermined delay, the timer allows the remaining stored energy in the capacitor to fire an ignition head in the detonator. The ignition head initiates explosive material, thus providing the explosive output for the detonator. Similar arrangements are seen in U.S. Pat. No. 5,173,569 to Pallanck et al, issued Dec. 22, 1992; in U.S. Pat. No. 5,377,592 to Rode et al, issued Jan. 3, 1995 (which teaches the use of a 3 microfarad ($\mu$f) storage capacitor rated at 35 volts) (see column 7, lines 11–15); and in U.S. Pat. No. 5,435,248 to Rode et al, issued Jul. 25, 1995. As taught in U.S. Pat. No. 5,435,248 at column 9, lines 41–50, the electronic circuits of such detonators are typically formed in a single integrated circuit ("IC") manufactured by a complementary metal oxide semiconductor ("CMOS") process used in conjunction with a 10 $\mu$f storage capacitor (rated at 35 volts) (see column 6, lines 45–52). CMOS circuitry is characterized by its low power consumption and low heat dissipation.

Semiconductor bridge ("SCB") igniters are known in the art, as disclosed in U.S. Pat. No. 4,708,060 to Bickes, Jr. et al, issued Nov. 24, 1987, which exemplifies the use of aluminum for the metallized pads of the SCB. Semiconductor bridge igniters utilizing tungsten for the metallized pads are also known, as disclosed in U.S. Pat. No. 4,976,200 to Benson et al, issued Dec. 11, 1990. Such devices generally have impedances of less than 10 ohms, e.g., about 1 ohm.

SUMMARY OF THE INVENTION

The present invention relates to a delay circuit that comprises an input terminal for receiving a charge of electrical energy, storage means connected to the input terminal for receiving and storing a charge of electrical energy, and an integrated, dielectrically isolated BiCMOS switching circuit connecting the storage means to an output terminal for providing a release of energy stored in the storage means to such output terminal. The switching circuit is responsive to a timer circuit. There is an output terminal connected to the storage means through the switching circuit and a timer circuit is operatively connected to the switching circuit for controlling the release to the output terminal by the switching circuit of energy stored in the storage means.

According to one aspect of the invention, the storage means may comprise a capacitor having a capacitance of less than about 3 microfarads rated at between 50 and 150 volts. For example, the capacitor may have a capacitance in the range of about 0.22 to 1 microfarad rated at between 50 and 150 volts.

According to another aspect of the invention, the circuit may further comprise a bridge initiation element connected to the output terminal. The storage means may have a capacitance and the switching circuit may have a discharge impedance. The storage means may have a time constant derived from the capacitance and the discharge impedance of less than about 15 microseconds. For example, the time constant may be in the range of from about 0.2 to 15 microseconds, e.g., the time constant may be about 2.5 microseconds.

According to another aspect of the invention, the switching circuit may have a discharge impedance of less than about 15 ohms. For example, the switching circuit may have a discharge impedance in the range of about 1 to 5 ohms.

The invention also pertains to a transducer-circuit assembly comprising a transducer module, an electronics module comprising (a) a delay circuit as described above with the input terminal operatively connected to the transducer module, and (b) an output initiation means operatively connected to the output terminal of the delay circuit for receiving the energy from the storage means and for producing an explosive output initiation signal.

The invention further relates to a detonator comprising a housing having a closed end and an open end, the open end being dimensioned and configured for connection to an initiation signal transmission means in the housing. The initiation signal transmission means delivers an electrical initiation signal to a delay circuit as described above. A detonator output means is disposed in the housing in operative relation to the storage means, for generating an output signal upon discharge of the storage means.

In a particular embodiment, the initiation signal transmission means may comprise the end of a shock tube, a booster charge and a transducer module all secured in the housing. These devices are arranged so that a non-electric signal emitted from the end of the shock tube will initiate the booster charge. The booster charge is disposed in force-communicating relation with the transducer module and the transducer module is operatively connected to the input terminal of the delay circuit.

As used herein and in the claims, the term "bridge initiation element" is meant to encompass semiconductor bridge igniters and tungsten bridge igniters.

DETAILED DESCRIPTION OF THE INVENTION AND PREFERRED EMBODIMENTS THEREOF

Figure 1:
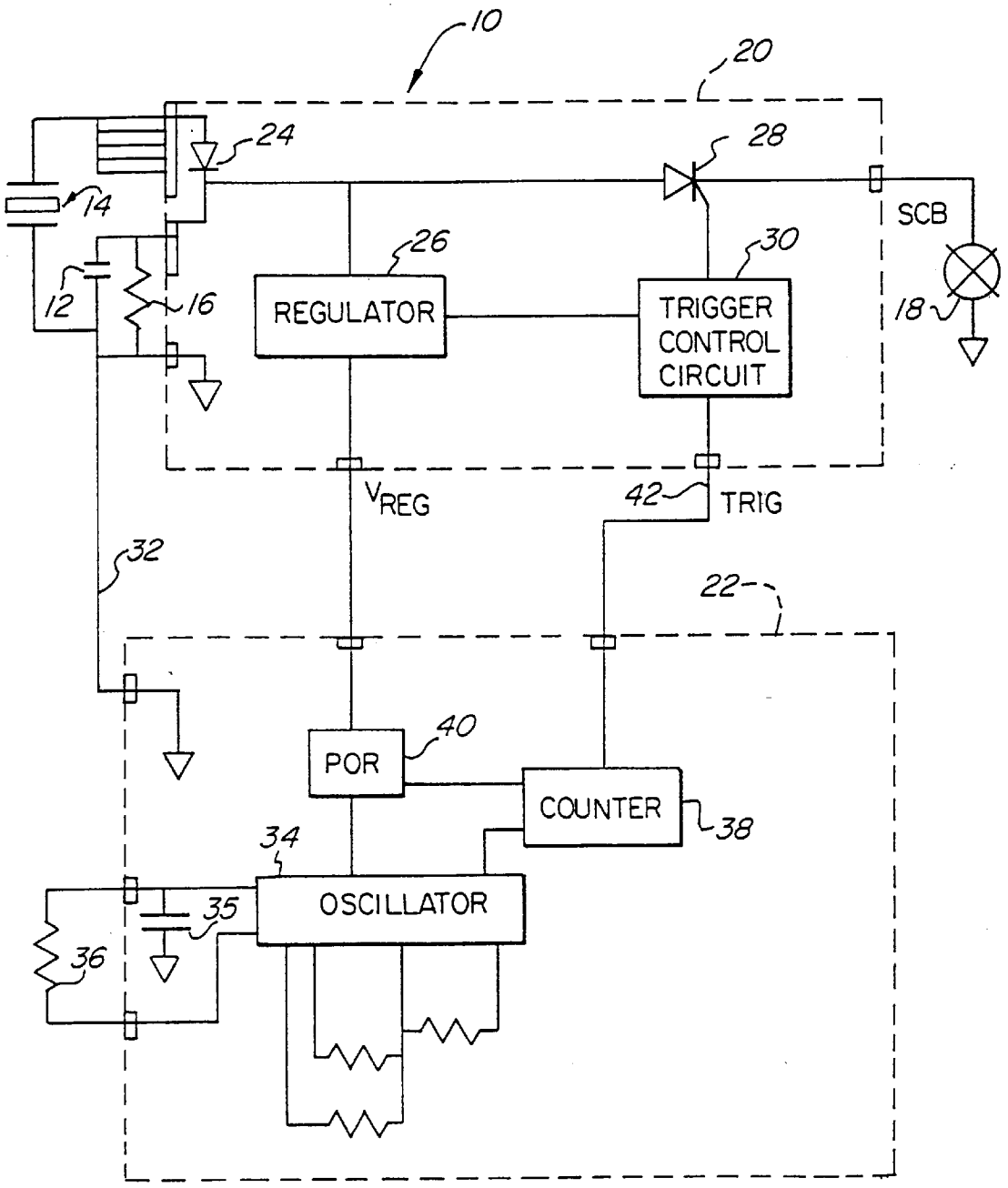
FIG. 1 is a schematic representation of a delay circuit in accordance with one embodiment of the present invention.

The present invention provides an improvement to electronic delay circuits which allows for greater efficiency in the transfer of electrical energy from an input terminal to an output terminal than was achieved in the prior art. The energy can be used in various ways, e.g., to initiate an output initiation element, e.g., a bridge initiation element. As a result, the output initiation element, which typically comprises a semiconductor bridge, can be initiated with less energy than is required for conventional initiation elements. This increased efficiency is attained by employing a dielectrically isolated, bipolar complementary metal oxide semiconductor ("DI BiCMOS") switching circuit, which preferably comprises an integrated switching element such as a silicon-controlled rectifier ("SCR") to serve as a switch between a storage means for electrical energy and the output terminal for the bridge initiation element. A CMOS integrated circuit may be used for the timing portion of the delay circuit. In contrast, the prior art (e.g., U.S. Pat. No. 5,435,248) teaches the use of CMOS circuitry for both timing and switching functions in conjunction with a discrete SCR. A circuit assembly of the present invention provides the enhanced efficacy of energy transfer attainable from a DI BiCMOS circuit and the low power consumption provided by a CMOS circuit.

A dielectrically isolated BiCMOS circuit, as used in accordance with the present invention, can accommodate higher voltages than a corresponding, prior art CMOS circuit. For example, a BiCMOS circuit may accommodate voltages up to, e.g., 150 volts, whereas CMOS circuits are typically limited to about 50 volts. Since the circuit of the present invention operates in the range of, e.g., 50 to 150 volts, it allows for the use of a storage capacitor of lesser capacitance than has been used in the prior art. As a result, the delay circuit has a smaller time constant (measured in seconds) for the discharge of the storage capacitor for initiation of the bridge initiation element than prior art circuits. The time constant may be calculated as the product of the capacitance of the storage capacitor (in farads) and the "discharge impedance" of the circuit (in ohms), i.e., the impedance imposed on the capacitor by the switching circuit and the bridge initiation element during such discharge. The discharge impedance can be approximated as the sum of the impedances of the switching element and the bridge initiation element. The smaller time constant translates to greater efficiency in energy transfer from the capacitor to the bridge initiation element.

A circuit in accordance with the present invention typically comprises a storage capacitor that is rated at less than 3 microfarads ($\mu$f), e.g., in the range of about 0.22 to 1 microfarad at about 50 to 150 volts, whereas prior art circuits employ capacitors rated at about 3 $\mu$f or more (e.g., U.S. Pat. No. 5,377,592 (3 $\mu$f); U.S. Pat. No. 5,435,248 (10 $\mu$f)). Further, the storage capacitor of a circuit according to the present invention may see a discharge impedance of 15 ohms or less, e.g., 5 ohms or even 1 ohm. The time constant for the discharge of the capacitor of the present invention is therefore quite small, e.g., 15 microseconds (e.g., 1 microfarad capacitor with 15 ohm switching circuit discharge impedance) or less, and may be as low as, e.g., about 0.22 microsecond (e.g., 0.22 $\mu$f capacitor with 1 ohm discharge impedance). For example, a typical time constant for the circuit of the present invention is expected to be about 2.5 microseconds (e.g., 0.5 $\mu$f capacitor with 5 ohm discharge impedance). Preferably, the impedance of the bridge initiation element is approximately equal to the impedance of the switching element so that energy from the storage capacitor is not unduly dissipated by the switching element during discharge to the bridge initiation element.

Bridge initiation elements, i.e., SCBs and tungsten bridges, are preferred over other initiation elements because of the relatively small energy requirements they have for initiation, their low impedance (usually less than 10 ohms, preferably about 1 ohm), their fast response time and superior heat transfer characteristics. SCBs also offer a high level of safety and reliability regarding all-fire and no-fire energies. As discussed more fully below, the bridge initiation element may comprise part of an output initiation means that may be secured to the circuit, and the output initiation means may comprise a part of an output means for a detonator.

An electronic detonator delay circuit in accordance with a particular embodiment of the present invention is illustrated schematically in FIG. 1 with a piezoelectric transducer 14 and a semiconductor bridge 18. Delay circuit 10 comprises a variety of circuit elements that may include discrete circuit elements and/or integrated circuits. Delay circuit 10 comprises, for example, a storage capacitor 12 that serves as a storage means for the assembly to receive and store a charge of electrical energy from an initiation signal means. In the illustrated embodiment, the electrical initiation signal is obtained from a piezoelectric transducer 14 which produces a pulse of electrical energy upon the receipt of a detonation shock wave. The detonation shock wave may be obtained from a detonating cord disposed in close proximity to transducer 14, as suggested by the Jonsson Patent, U.S. Pat. No. 5,133,257. Alternatively, the detonation shock wave may be obtained from a booster charge associated with the circuit assembly, as described more fully below. The energy produced by transducer 14 is conveyed to storage capacitor 12 through a steering diode 24. A bleed resistor 16 is positioned to discharge storage capacitor 12 in the event that energy stored by capacitor 12 is not otherwise discharged by delay circuit 10. Ordinarily, a detonator delay circuit is designed to initiate an output charge by discharging the storage capacitor within a delay interval in the range of from 1 millisecond to 10 seconds from the receipt of the initiation signal. Bleed resistor 16 is chosen so that it discharges storage capacitor 12 over a significantly longer time period than the anticipated delay interval. For example, bleed resistor 16 may be chosen to discharge storage capacitor 12 over a time period of fifteen minutes.

SCB 18 is connected to the output terminal of switching circuit 20 and is thus operatively connected to storage capacitor 12. The operation of switching circuit 20 is controlled by a timer circuit 22. As illustrated, both switching circuit 20 and timer circuit 22 draw power for their operation from storage capacitor 12, although in alternative embodiments of the invention, separate power sources, such as battery cells, may optionally be provided to power these circuits.

Integrated switching circuit 20 comprises a voltage regulator 26, an integrated silicon-controlled rectifier (SCR) 28 and a trigger control signal circuit 30. SCR 28 serves as a switching element through which energy stored in storage capacitor 12 can be delivered to SCB 18. The operation of SCR 28 is controlled by trigger circuit 30 which is responsive to a firing signal issued by timer circuit 22. Regulator 26 steps down the voltage stored in capacitor 12 to provide a power source for trigger circuit 30 and for timer circuit 22.

Timer circuit 22 draws power from storage capacitor 12 via lead 32. Timer circuit 22 comprises an oscillator 34, the frequency of which is determined in part by a timing capacitor 35 and by the selection of an external timing resistor 36. Timer circuit 22 also comprises a counter 38 and a power-on reset ("POR") circuit 40. Upon receipt of power from storage capacitor 12 and regulator 26, POR circuit 40 initiates oscillator 34 and sets counter 38 to a predetermined reset state. In response to pulses received from oscillator 34, counter 38 decrements from the reset state and, when the predetermined interval is counted, counter 38 issues a firing signal via firing lead 42. The firing signal activates trigger circuit 30 which activates SCR 28. The remaining stored energy in storage capacitor 12 is then discharged through SCR 28 to SCB 18.

In the illustrated embodiment, switching circuit 20 is formed as an integrated BiCMOS circuit in which the integrated circuit elements are dielectrically isolated (DI) from each other. Timer circuit 22, however, is a conventional CMOS integrated circuit and is therefore able to perform its timing and initiation signaling functions while drawing minimal energy from storage capacitor 12. The relatively high impedance of the CMOS timer circuit 22 does not detract from the efficiency with which energy is conveyed from storage capacitor 12 to SCB 18. For example, using a 0.5 $\mu$f capacitor and a switching circuit having a 5 ohm discharge impedance, switching circuit 20 can discharge 50 microjoules ($\mu$J) (i.e., 0.05 millijoule (mJ)) from storage capacitor 12 in about 1 to 3 microseconds to initiate SCB 18. Prior art circuits, in contrast, require at least 0.25 mJ for the initiation of a bridge initiation element in the same time frame. See, e.g., U.S. Pat. No. 5,309,841 to Hartman et al issued May 10, 1994, at column 7, lines 10–15 (5 volts applied for 10 microseconds); and U.S. Pat. No. 4,708,060 issued to Bickes, Jr. et al issued Nov. 24, 1987, at column 6, lines 713 (1–5 mJ). The ability to initiate SCB 18 with such a small amount of electrical energy improves the reliability of the delay circuit since it is then less likely that switching circuit 20 and timer circuit 22 will discharge storage capacitor 12 to such a degree that it is unable, after the predetermined delay, to initiate SCB 18. In addition, smaller time constants of circuits of the present invention contribute to more uniform performance among similarly configured circuits.

As a further result of the bifurcation of high voltage and low voltage functions of the delay circuit into dielectrically isolated BiCMOS and conventional CMOS integrated circuits, the overall size of the delay circuit is smaller than corresponding prior art CMOS-only circuits such as is shown in U.S. Pat. No. 5,173,569 to Pallanck et al. This reduction in size is attained because certain circuit elements which previously had to be discrete units can be incorporated into the integrated circuits. For example, steering diode 24 and SCR 28 are formed as part of the dielectrically isolated BiCMOS switching circuit 20, whereas prior art steering diodes and SCRs could not be incorporated into a standard CMOS circuit and so were present as discrete circuit elements. In addition, because the DI BiCMOS portion of the circuit can accommodate higher voltages than a CMOS circuit, the delay circuit can comprise a smaller storage capacitor than prior art circuits. Specifically, storage capacitor 12 of the present invention can be a ceramic-type capacitor, which is smaller, less expensive and easier to incorporate in delay circuit 10 than prior art storage capacitors, which are generally of the wound film type. The size reduction resulting from the bifurcation of the delay circuit functions into CMOS and DI BiCMOS portions allows the delay circuitry of the present invention to be incorporated into a detonator having a standard size shell for a conventional No. 8 or No. 12 detonator, which are generally cylindrical in shape and have a 0.296 inch (0.117 cm) diameter. Therefore, the present invention provides an electronic detonator that can be used with the variety of conventional blasting products such as booster charges, connector devices, etc., that are configured for standard-sized detonators, and gives the user the advantages of delays having digitally-controlled precision. There is even room in the detonator for protective circuit encapsulation, such as encapsulation 15 (FIG. 2), which protects the detonator circuit from external vibration. In contrast, prior art digitally controlled detonator circuits are so large that they require oversized shells and so cannot be used with many standard blasting components.

Figure 2:
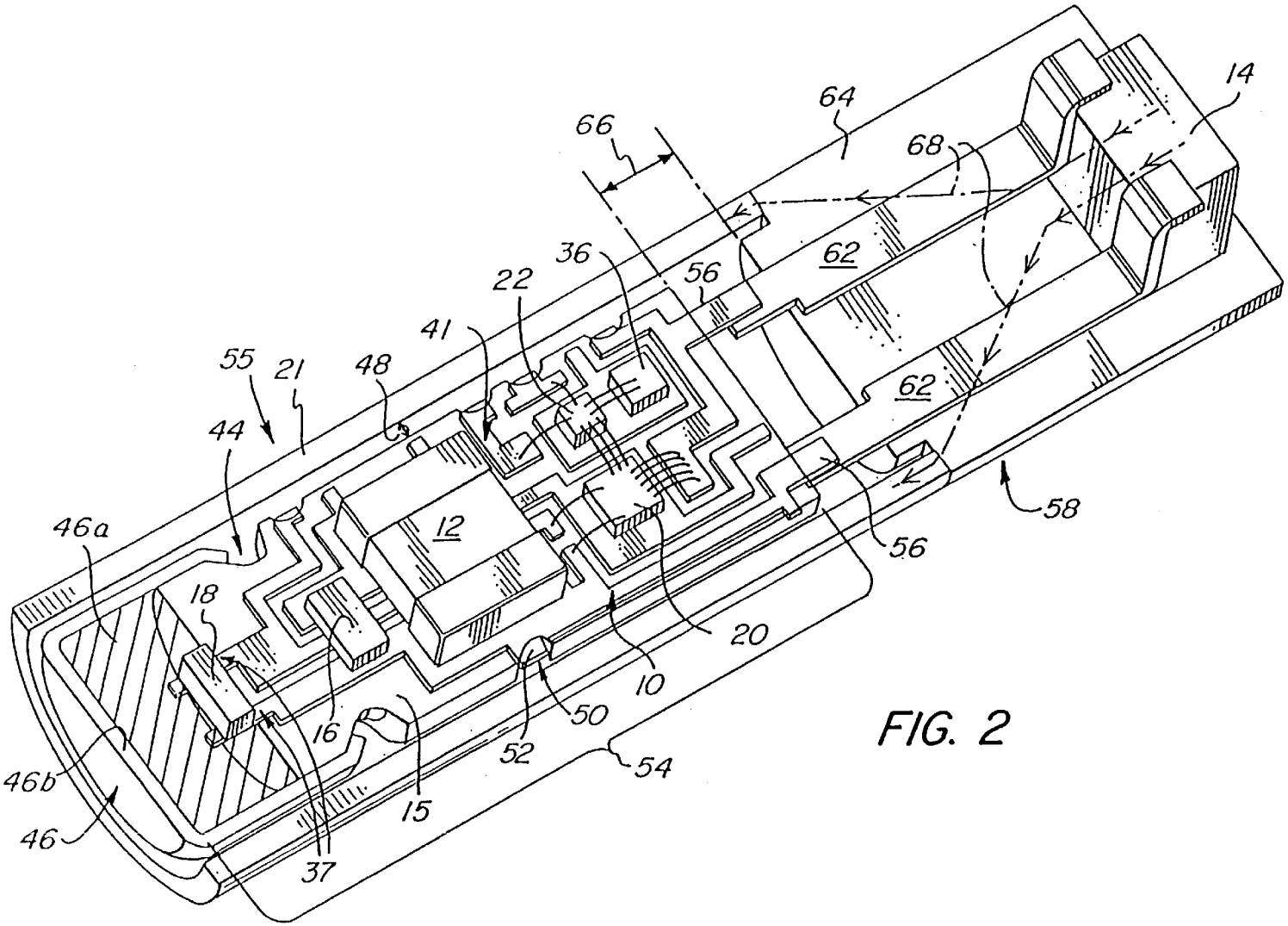
FIG. 2 is a partly cross-sectional perspective view of a transducer-delay initiation assembly comprising an electronics module and sleeve together with a transducer module.

FIG. 2 provides a perspective view of transducer-circuit assembly 55 comprising an electronics module 54 that comprises the delay circuit 10 of FIG. 1 with an output initiation means 46 attached thereto. The delay circuit 10 includes various circuit components including timer circuit 22, a timing resistor 36, a switching circuit 20, a storage capacitor 12, a bleed resistor 16 and output leads 37 that provide an output terminal to which storage capacitor 12 is discharged. These various components are mounted on lattice-like portions or traces 41 of a lead frame and, except for output leads 37, are disposed within encapsulation 15. In the illustrated embodiment, the output initiation means 46 comprises, in addition to semiconductor bridge 18 (which is connected across output leads 37), an initiation charge 46*a*, which preferably comprises a fine particulate explosive material and an initiation shell 46*b* that is crimped onto neck region 44 of encapsulation 15 and which holds initiation charge 46*a* in energy transfer relation to semiconductor bridge 18. Initiation charge 46*a* is preferably pressed in initiation shell 46*b* to a density of less than 80 percent of its maximum theoretical density (MTD). Preferably, SCB 18 is secured to output leads 37 in a manner that allows SCB 18 to protrude into, and to be surrounded by, initiation charge 46*a*. Alternatively, such materials may be rendered in the form of a slurry or bead mix that can be applied onto the SCB. Output initiation means 46 may comprise part of the output means of a detonator and may be used, e.g., to initiate the base charge or "output" charge of the detonator in which transducer-circuit assembly 55 is disposed, as described below.

Encapsulation 15 preferably engages sleeve 21 only along longitudinally extending protuberant ridges or fins (which are not visible in FIG. 2) and thus establishes a gap 48 between encapsulation 15 and sleeve 21 at the circumferential regions about encapsulation 15 between the fins. As an alternative to fins, encapsulation 15 may be configured to have protuberant bosses to engage the interior surface of a surrounding sleeve or detonator shell, or it may be polygonal in cross section and engage sleeve 21 along longitudinal apices or edges, or it may have any other configuration effective to dissipate shock waves that may be transmitted to the circuit from the exterior of the device. Generally, such configurations minimize or at least reduce the surface area contact between encapsulation 15 and sleeve 21. In addition, some or all of encapsulation 15 may comprise a shock-absorbing material. Alternatively, encapsulation 15 may comprise a shock-absorbing material that may optionally make full contact with sleeve 21.

In the illustrated embodiment, encapsulation 15 optionally defines scallops 50 that make test leads 52 accessible but which preferably allow the leads to remain within the surface profile of encapsulation 15, i.e., the leads preferably do not extend into gap 48. If scallops 50 are omitted, it is preferred that the test leads do not extend across gap 48 to contact the surrounding enclosure. Accordingly, before the electronics module (which comprises the various circuit elements, output initiation means 46 and encapsulation 15) is placed within sleeve 21, leads such as lead 52 can be accessed to test the assembled circuitry. Then, electronics module 54 can be inserted into sleeve 21 and leads 52 will not contact sleeve 21.

Electronics module 54 is designed so that output leads 37 and initiation input leads 56, through which storage capacitor 12 can be charged, protrude from respective opposite ends of electronics module 54. A transducer module 58 comprises a piezoelectric transducer 14 and two transfer leads 62 enclosed within transducer encapsulation 64. Transducer encapsulation 64 is dimensioned and configured to engage sleeve 21 so that transducer module 58 can be secured onto the end of sleeve 21 with leads 62 in contact with input leads 56. Preferably, encapsulation 15, sleeve 21 and transducer encapsulation 64 are dimensioned and configured so that, when assembled as shown in FIG. 2, an air gap indicated at 66 is established between encapsulation 15 and transducer encapsulation 64. In this way, electronics module 54 is at least partially shielded from the detonation shock wave that causes piezoelectric transducer 14 to create the electrical pulse that initiates electronics module 54. The pressure imposed by such detonation shock wave is transferred through transducer module 58 onto sleeve 21, as indicated by force arrows 68, rather than onto electronics module 54.

In contrast to prior art detonator delay circuits, in which the various circuit packages and elements were mounted on a polymeric or ceramic substrate in a chip-on-board type arrangement, the integrated circuits and circuit elements of delay circuit 10 may be mounted directly on the metal traces 41 of a lead frame. This assembly procedure is less costly than prior art procedures and reduces the size of the delay circuit, simplifies the integration process and allows for a larger, more protective encapsulation.

Figure 3A:
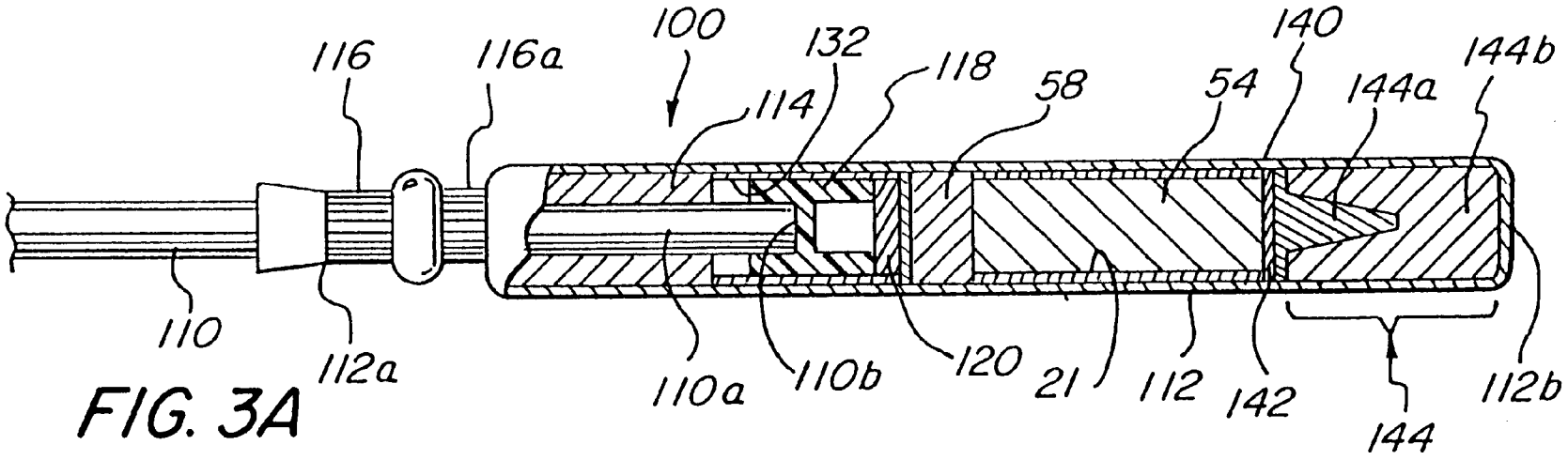
FIG. 3A is a schematic, partly cross-sectional view showing a delay detonator comprising an encapsulated electronic circuit in accordance with one embodiment of the present invention.

Referring now to FIG. 3A there is shown one embodiment of a digital delay detonator 100 comprising an electronics module in accordance with the present invention. Delay detonator 100 comprises a housing 112 that has an open end 112*a* and a closed end 112*b*. Housing 112 is made of an electrically conductive material, usually aluminum, and is preferably the size and shape of conventional blasting caps, i.e., detonators. Detonator 100 comprises an initiation signal transmission means for delivering an electrical initiation signal to the delay circuit. The initiation signal transmission means may simply comprise an electrical initiation signal line that may be directly connected to the input terminal of a suitably configured delay circuit in accordance with the present invention. Preferably, however, the detonator is used as part of a non-electrical system and the initiation signal transmission means comprises the end of a non-electric signal transmission line (e.g., shock tube) and a transducer for converting the non-electric initiation signal to an electrical signal, as described herein. In the illustrated embodiment, the delay detonator 100 is coupled to a non-electric initiation signal means that comprises, in the illustrated case, a shock tube 110, booster charge 120 and transducer module 58. It will be understood that non-electric signal transmission lines besides shock tube, such as a detonating cord, low energy detonating cord, low velocity shock tube and the like may be used. As is well-known to those skilled in the art, shock tube comprises hollow plastic tubing, the inside wall of which is coated with an explosive material, so that, upon ignition, a low energy shock wave is propagated through the tube. See, for example, Thureson et al, U.S. Pat. No. 4,607,573, issued Aug. 26, 1986. Shock tube 110 is secured in housing 112 by an adapter bushing 114 that surrounds tube 110. Housing 112 is crimped onto bushing 114 at crimps 116, 116*a* to secure shock tube 110 in housing 112 and to form an environmentally protective seal between housing 112 and the outer surface of shock tube 110. A segment 110*a* of shock tube 110 extends within housing 112 and terminates at end 110*b* in close proximity to, or in abutting contact with, an anti-static isolation cup 118.

Figure 3B:
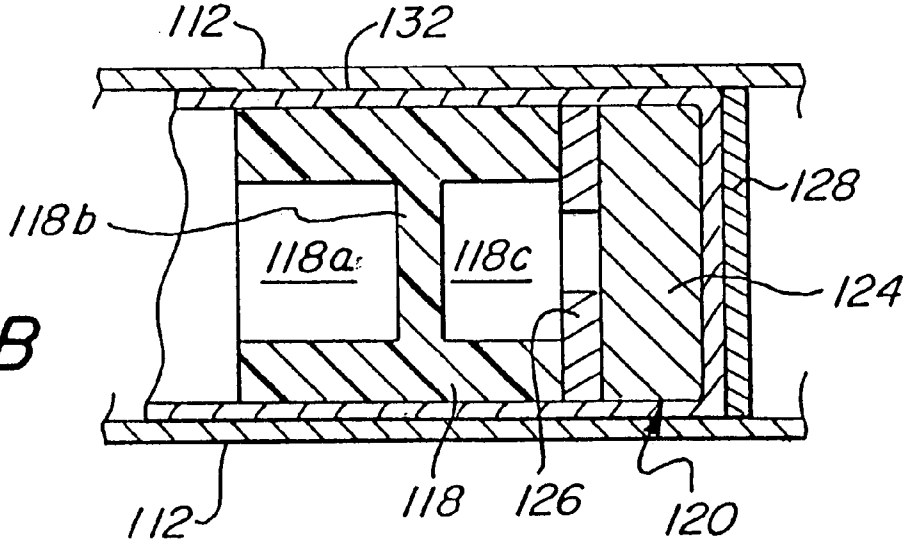
FIG. 3B is a view, enlarged relative to FIG. 3A, of the isolation cup and booster charge components of the detonator of FIG. 3A.

Isolation cup 118 has a friction fit inside housing 112 and is made of a semi-conductive material, e.g., a carbon-filled polymeric material, so that it forms a conductive grounding path from shock tube 110 to housing 112 to dissipate any static electricity which may travel along shock tube 110. Such isolation cups are well-known in the art. See, e.g., U.S. Pat. No. 3,981,240 to Gladden, issued Sep. 21, 1976. A low energy booster charge 120 is positioned adjacent to anti-static isolation cup 118. As best seen in FIG. 3B, anti-static isolation cup 118 comprises, as is well-known in the art, a generally cylindrical body (which is usually in the form of a truncated cone, with the larger diameter end disposed towards the open end 112*a* of housing 112) which is divided by a thin, rupturable membrane 118*b* into an entry chamber 118*a* and an exit chamber 118*c*. The end 110*b* of shock tube 110 (FIG. 3A) is received within entry chamber 118*a* (shock tube 110 is not shown in FIG. 3B for clarity of illustration). Exit chamber 118*c* provides an air space or stand-off between the end 110*b* of shock tube 110 and booster charge 120 which are disposed in mutual signal transfer relation to each other. In operation, the shock wave signal emitted from end 110*b* of shock tube 110 will rupture membrane 118*b*, traverse the stand-off provided by exit chamber 118*c* and initiate booster charge 120.

Booster charge 120 comprises a small quantity of a primary explosive 124 such as lead azide (or a suitable secondary explosive material such as BNCP), which is disposed within a booster shell 132 and upon which is disposed a first cushion element 126 (not shown in FIG. 3A for ease of illustration). First cushion element 126, which is annular in configuration except for a thin central membrane, is located between isolation cup 118 and explosive 124, and serves to protect explosive 124 from pressure imposed upon it during manufacture.

Isolation cup 118, first cushion element 126, and booster charge 120 may conveniently be fitted into a booster shell 132 as shown in FIG. 3B. The outer surface of isolation cup 118 is in conductive contact with the inner surface of booster shell 132 which in turn is in conductive contact with housing 112 to provide an electrical current path for any static electricity discharged from shock tube 110. Generally, booster shell 132 is inserted into housing 112 and housing 112 is crimped to retain booster shell 132 therein as well as to protect the contents of housing 112 from the environment.

A non-conductive buffer 128 (not shown in FIG. 3A for ease of illustration), which is typically 0.015 inch thick, is located between booster charge 120 and transducer module 58 to electrically isolate transducer module 58 from booster charge 120. Transducer module 58 comprises a piezoelectric transducer (not shown in FIG. 3A) that is disposed in force-communicating relationship with booster charge 120 and so can convert the output force of booster charge 120 to a pulse of electrical energy. Transducer module 58 is operatively connected to electronics module 54 as shown in FIG. 2. The initiation signal transmission means comprising shock tube segment 110*b*, booster charge 120 and transducer module 58 serves to deliver to delay circuit 10, in electrical form, a non-electric initiation signal received via shock tube 110, as described below.

The enclosure provided by detonator 100 comprises, in addition to housing 112, the optional open-ended steel sleeve 21 that encloses electronics module 54.

Electronics module 54 comprises at its output end an output initiation means 46 (shown in FIG. 2), which comprises part of the output means for the detonator. Adjacent to the output initiation means of electronics module 54 is a second cushion element 142, which is similar to first cushion element 126. Second cushion element 142 separates the output end of electronics module 54 from the remainder of the detonator output means, comprising an output charge 144 that is pressed into the closed end 112*b* of housing 112. Output charge 144 comprises a secondary explosive 144*b* that is sensitive to the output initiation means of electronics module 54 and that has sufficient shock power to detonate cast booster explosives, dynamite, etc. Output charge 144 may optionally comprise a relatively small charge of a primary explosive 144*a* for initiating secondary explosive 144*b*, but primary explosive 144*a* may be omitted if the initiation charge of electronics module 54 has sufficient output strength to initiate secondary explosive 144*b*. The secondary explosive 144*b* has sufficient shock power to rupture housing 112 and detonate cast booster explosives, dynamite, etc., disposed in signal transfer proximity to detonator 100.

In use, a non-electric initiation signal traveling through shock tube 110 is emitted at end 110*b*. The signal ruptures membrane 118*b* of isolation cup 118 and first cushion element 126 to activate booster charge 120 by initiating primary explosive 124. Primary explosive 124 generates a detonation shock wave that imposes an output force on the piezoelectric generator in transducer module 58. The piezoelectric generator is in force-communicating relationship with booster charge 120 and so converts the output force to an electrical output signal in the form of a pulse of electrical energy that is received by electronics module 54. As indicated above, electronics module 54 stores the pulse of electric energy and, after a predetermined delay, releases or conveys the energy to the detonator output means. In the illustrated embodiment, the charge is released to the output initiation means, which initiates output charge 144. Output charge 144 ruptures housing 112 and emits a detonation output signal that can be used to initiate other explosive devices, as is well-known in the art.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims. For example, while the hybrid timer and switching circuit of the present invention is illustrated above by an embodiment adapted for use in a detonator secured to a non-electric initiation signal transmission line (e.g., shock tube 110), it will be understood that the invention can be practiced with detonators secured to electrical signal transmission lines as well.

What is claimed is:

1. A delay circuit comprising:

an input terminal for receiving a charge of electrical energy;

storage means connected to the input terminal for receiving and storing a charge of electrical energy;

an integrated, dielectrically isolated BiCMOS switching circuit comprising integrated circuit elements being dielectrically isolated from each other and connecting the storage means to an output terminal for releasing energy stored in the storage means to such output terminal in response to a signal from a timer circuit;

an output terminal connected to the storage means through the switching circuit; and the timer circuit being operatively connected to the switching circuit for controlling the release to the output terminal by the switching circuit of energy stored in the storage means, wherein the timer circuit comprises a CMOS integrated circuit.

2. The circuit of claim 1 wherein the storage means has a capacitance of less than about 3 microfarads rated at between 50 and 150 volts.

3. The circuit of claim 2 wherein the storage means has a capacitance in the range of about 0.22 to 1 microfarad rated at between 50 and 150 volts.

4. The circuit of claim 1, claim 2 or claim 3 further comprising a bridge initiation element connected to the output terminal, wherein the storage means has a capacitance and the switching circuit has a discharge impedance, the storage means having a time constant, derived from the capacitance and the discharge impedance, of less than about 15 microseconds.

5. The circuit of claim 4 having a time constant in the range of from about 0.2 to 15 microseconds.

6. The circuit of claim 5 having a time constant of about 2.5 microseconds.

7. The circuit of claim 2 or claim 3 wherein the switching circuit has a discharge impedance of less than about 15 ohms.

8. The circuit of claim 7 wherein the switching circuit has a discharge impedance in the range of about 1 to 5 ohms.

9. A transducer-circuit assembly comprising:

a transducer module for converting a shock wave pulse into a pulse of electrical energy;

an electronics module comprising (a) a delay circuit comprising:

(i) storage means connected to the transducer module for receiving and storing electrical energy from the transducer module;

(ii) an integrated, dielectrically isolated BiCMOS switching circuit comprising integrated circuit elements being dielectrically isolated from each other and connecting the storage means to an output initiation means for releasing energy stored in the storage means to an output initiation means in response to a signal from a timer circuit; and (iii) the timer circuit being operatively connected to the switching circuit for controlling the release to the output terminal by the switching circuit of energy stored in the storage means; and (b) an output initiation means operatively connected to the storage means through the switching circuit for receiving the energy from the storage means and for generating an output initiation signal in response thereto, wherein the timer circuit comprises a CMOS integrated circuit.

10. The assembly of claim 9 wherein the storage means has a capacitance C and the switching circuit has a discharge impedance R, the switching circuit having a time constant derived from the capacitance C and the discharge impedance R of less than about 15 microseconds.

11. The assembly of claim 10 having a time constant in the range of from about 0.2 to 15 microseconds.

12. The assembly of claim 11 having a time constant of about 2.5 microseconds.

13. The assembly of claim 10, claim 11 or claim 12 wherein the storage means has a capacitance of less than about 3 microfarads rated at between 50 and 150 volts and the switching circuit has a discharge impedance of less than about 15 ohms.

14. The assembly of claim 13 wherein the storage means has a capacitance in the range of from about 0.22 to 1 microfarad rated at between 50 and 150 volts and the switching circuit has a discharge impedance in the range of about 1 to 5 ohms.

15. A detonator comprising:

a housing having a closed end and an open end, the open end being dimensioned and configured for connection to an initiation signal transmission means;

an initiation signal transmission means in the housing for delivering an electrical initiation signal to the input terminal of a delay circuit;

a delay circuit in the housing comprising (i) an input terminal for receiving a charge of electrical energy, (ii) storage means connected to the input terminal for receiving and storing a charge of electrical energy, (iii) an integrated, dielectrically isolated BiCMOS switching circuit comprising integrated circuit elements being dielectrically isolated from each other and connecting the storage means to an output terminal for releasing energy stored in the storage means to a target device connected to an output initiation means in response to a signal from a timer circuit, (iv) an output terminal connected to the storage means through the switching circuit, and (v) the timer circuit being operatively connected to the switching circuit for controlling the release to the output terminal by the switching circuit of energy stored in the storage means; and detonator output means disposed in the housing in operative relation to the storage means for generating an output signal upon discharge of the storage means, wherein the timer circuit comprises a CMOS integrated circuit.

16. The detonator of claim 15 wherein the storage means has a capacitance C and the switching circuit has a discharge impedance R, the storage means having a time constant derived from the capacitance C and the discharge impedance R of less than about 15 microseconds.

17. The detonator of claim 16 having a time constant in the range of from about 0.2 to 15 microseconds.

18. The detonator of claim 17 having a time constant of about 2.5 microseconds.

19. The detonator of claim 15, claim 16, claim 17 or claim 18 wherein the storage means has a capacitance of less than about 3 microfarads rated at between 50 and 150 volts and the switching circuit has a discharge impedance of less than about 15 ohms.

20. The detonator of claim 19 wherein the storage means has a capacitance in the range of about 0.22 to 1 microfarad rated at between 50 and 150 volts and wherein the switching circuit has a discharge impedance in the range of about 1 to 5 ohms.

21. The detonator of claim 15 wherein the initiation signal transmission means comprises the end of a shock tube, a booster charge and a transducer module all secured in the housing and arranged so that a non-electric initiation signal emitted from the end of the shock tube initiates the booster charge, which is disposed in force-communicating relation with the transducer module, the transducer module being operatively connected to the input terminal of the delay circuit.

22. A transducer-circuit assembly comprising:

a transducer module for converting a shock wave pulse into a pulse of electrical energy;

an electronics module comprising (a) a delay circuit comprising:

(i) storage means connected to the transducer module for receiving and storing electrical energy from the transducer module;

(ii) an integrated, dielectrically isolated BiCMOS switching circuit comprising integrated circuit elements being dielectrically isolated from each other and connecting the storage means to an output initiation means for releasing energy stored in the storage means to an output initiation means in response to a signal from a timer circuit; and (iii) the timer circuit being operatively connected to the switching circuit for controlling the release to the output terminal by the switching circuit of energy stored in the storage means; and (b) an output initiation means operatively connected to the storage means through the switching circuit for receiving the energy from the storage means and for generating an output initiation signal in response thereto;

wherein the storage means has a capacitance in the range of from about 0.22 to 1 microfarad rated at between 50 and 150 volts and the switching circuit has a discharge impedance in the range of about 1 to 5 ohms.

23. The assembly of claim 22 having a time constant of about 2.5 microseconds.

24. A detonator comprising:

a housing having a closed end and an open end, the open end being dimensioned and configured for connection to an initiation signal transmission means;

an initiation signal transmission means in the housing for delivering an electrical initiation signal to the input terminal of a delay circuit;

a delay circuit in the housing comprising (i) an input terminal for receiving a charge of electrical energy, (ii) storage means connected to the input terminal for receiving and storing a charge of electrical energy, (iii) an integrated, dielectrically isolated BiCMOS switching circuit comprising integrated circuit elements being dielectrically isolated from each other and connecting the storage means to an output terminal for releasing energy stored in the storage means to a target device connected to an output initiation means in response to a signal from a timer circuit, (iv) an output terminal connected to the storage means through the switching circuit, and (v) the timer circuit being operatively connected to the switching circuit for controlling the release to the output terminal by the switching circuit of energy stored in the storage means; and detonator output means disposed in the housing in operative relation to the storage means for generating an output signal upon discharge of the storage means;

wherein the storage means has a capacitance in the range of about 0.22 to 1 microfarads rated at between 50 and 150 volts and wherein the switching circuit has a discharge impedance in the range of about 1 to 5 ohms.

25. The detonator of claim 24 having a time constant of about 2.5 microseconds.

* * * * *

UNITED STATES PATENT AND TRADEMARK OFFICE

CERTIFICATE OF CORRECTION

PATENT NO. : 5,929,368
DATED : July 27, 1999
INVENTOR(S) : Ewick et al.

It is certified that error appears in the above-identified patent and that said Letters Patent is hereby corrected as shown below:

Column 5,
Line 27, replace "713" with -- 7-13 --.

Column 10, claim 10,
Lines 53 and 55, remove "C" after "capacitance";
Lines 54 and 56, remove "R" after "impedance".

Column 11, claim 16,
Lines 34 and 36, remove "C" after "capacitance";
Lines 35 and 37, remove "R" after "impedance".

Signed and Sealed this

Sixteenth Day of April, 2002

*Attest:*

*Attesting Officer*

JAMES E. ROGAN
*Director of the United States Patent and Trademark Office*